US006941982B1

(12) United States Patent
Swan et al.

(10) Patent No.: US 6,941,982 B1
(45) Date of Patent: Sep. 13, 2005

(54) FOOD HOLDER

(76) Inventors: Donald Martin Swan, 43 Polhemus Ter., Whippany, NJ (US) 07981; George Makris, 13 Pilot Pl., West Orange, NJ (US) 07052

( * ) Notice: Subject to any disclaimer, the term of this patent is extended or adjusted under 35 U.S.C. 154(b) by 0 days.

(21) Appl. No.: 10/839,848

(22) Filed: May 6, 2004

(51) Int. Cl.[7] ..... B65B 1/04
(52) U.S. Cl. ..... 141/86; 229/932; 426/139
(58) Field of Search ..... 141/86; 229/932; 426/132, 139, 115

(56) References Cited

U.S. PATENT DOCUMENTS

| | | | |
|---|---|---|---|
| 1,800,759 | A | 4/1931 | Shean |
| 1,920,995 | A | 8/1933 | Legge |
| 2,362,595 | A | 11/1944 | Torrison |
| 2,948,452 | A | 8/1960 | Grogan et al. |
| 3,306,512 | A | 2/1967 | Pagnini |
| 4,226,355 | A | 10/1980 | Helfrich, Jr. |
| 4,718,594 | A | 1/1988 | Harazi |
| 4,720,037 | A | 1/1988 | Alpert |
| 4,938,411 | A | 7/1990 | Rizzuto |
| 5,152,454 | A | 10/1992 | Warta et al. |
| 5,224,646 | A | 7/1993 | Biancosino |
| 5,770,250 | A | 6/1998 | Smith |
| 6,230,764 | B1 | 5/2001 | Rodman |
| 6,237,646 | B1 | 5/2001 | Rodman |

*Primary Examiner*—Timothy L. Maust
(74) *Attorney, Agent, or Firm*—St. Onge Steward Johnston & Reens LLC

(57) ABSTRACT

An food holder attachable to the outside of the food, such as an ice cream cone, for capturing liquid, the liquid be captured by an absorbent material and in a plurality of channels and interconnections for maximizing the surface of the absorbent material, the channels having openings to allow the liquid to enter via gravity, but small enough that upon momentary tilting of the food the liquid will not spill out of the holder.

18 Claims, 3 Drawing Sheets

FOOD HOLDER

FIELD OF THE INVENTION

The invention relates to a food holder for holding a food and capturing liquid, and more specifically for capturing and maintaining liquid in the holder when the holder is tilted.

BACKGROUND OF THE INVENTION

The dispensing and consuming of food and specifically for instance ice cream, especially in an ice cream cone, has been a favorite summer pastime for many years. Typically food and ice cream sales rise during the warmer seasons when cold treats are in higher demand. However, a problem that has been faced by adults and children for many years is liquid such as for instance melting ice cream creating a mess for the individual, especially in connection with an ice cream cone.

Ice cream is stored at a very low temperature prior to dispensing and when maintained at this low temperature, typically maintains a generally solid form. However, upon exposure to an elevated temperature such as for instance room temperature, heat transfers from the air to the ice cream thereby transforming it from a generally solid state to a generally liquid state.

For anyone who has had to contend with this transformation, those who cannot or do not consume the ice cream quickly encounter a sticky mess as the melted ice cream will run down the sides of the ice cream cone onto the individual and/or their clothing. Thus was created the technique of licking around and around the perimeter of the ice cream in an attempt to consume the surface portion of the ice cream as it begins to melt. For some, this technique may provide a measure of success, for others especially children, the result can be quite a mess both for the adult and the child.

A number of U.S. patents have attempted to deal with this problem. For instance, U.S. Pat. No. 1,800,759 to Shean discloses an ice cream cone cup holder formed in the shape of the cone and made of waxed paper and having corrugations for transporting the melted ice cream downward to the bottom of the ice cream cone cup holder. However, a problem with this device is that the melted ice cream runs down the outside of the cone such that if an individual desires to eat the cone it is a messy experience. In addition, if the cone is tilted the melted ice cream will run out.

U.S. Pat. No. 2,362,595 to Torrison discloses an ice cream cone holder having a generally conical shape having a closed lower end and an open upper end for receiving the ice cream cone. The holder is made of a paper material and having an edge at an upper end of the holder with tabs that facilitate melted ice cream entering the holder. However, a problem with this device is that the opening to receive the melted ice cream is much too close to the surface of the ice cream cone such that dripping of the melted ice cream does not run into the holder. In addition, melted ice cream runs down the outside of the cone making a mess. Still further, if the cone is tilted the melted ice cream will run out.

U.S. Pat. No. 2,948,452 to Grogan et al., U.S. Pat. No. 3,306,512 to Pagnini, and U.S. Pat. No. 4,718,594 to Harazi disclose a drip catching tray extending outward beyond the upper edges of the ice cream cone. These devices are illustrated with having an open upper end for receiving the ice cream cone and an open lower end for the cone to protrude through. However, one problem with these devices is that the melted ice cream messily runs down the side of the cone to collect in the tray portion. In addition, if an individual inadvertently tips the tray, the melted ice cream will run out creating an even greater mess.

U.S. Pat. No. 5,152,454 to Warta et al. discloses a wrapper made from for instance paper, which may be applied to a cone to form an upper conic section and a lower conic section, the lower conic section being tightly held to the cone and the upper section flaring away from the cone. However, a problem with this design is that the melted ice cream is held against the cone such that if the individual desires to consume the cone a messy challenge awaits them. Another problem with this design is that when this device is used with a cone that has for instance an uneven surface, the lower cone will not mate against the cone surface tightly enough to prevent leakage. Still further, while the upper cone area is angled inward to the cone to a greater degree than the trays discussed above, an individual may still spill the melted ice cream from the holder if the cone was tipped inadvertently.

U.S. Pat. Nos. 6,230,764 and 6,237,646 both to Rodman disclose an ice cream cone holder and drip collector device having an open upper end for receiving a cone and a closed lower end fitting tightly against the cone. A drip catcher extends outward from the cone surface to catch any melting ice cream. However, a problem with this design is that again an individual may still spill the melted ice cream collected in the catcher if the cone was tipped inadvertently.

SUMMARY OF THE INVENTION

What is desired then is a food holder such as for instance ice cream that will not readily spill liquid therefrom in the event an individual tips the food off of vertical axis.

It is further desired to provide a food holder that will allow liquid such as melted ice cream to be held inside of the holder away from the food, such as a cone.

It is still further desired to provide an ice cream cone holder that in one embodiment is reusable.

It is yet further desired to provide an ice cream cone holder that prevents leaks therefrom.

These and other objectives are attained by a device that essentially comprises a sleeve that fits on the outside of the food and allows the liquid to drip inside of it sealing it away from the food and the individual. When used with an ice cream cone, typically a top diameter of the sleeve will larger than the cone diameter with the angle of the sleeve being different than the angle of the cone.

In one advantageous embodiment a food holder is provided comprising an inner wall following a contour of the food inserted therein and an outer wall following a contour that is different than the contour of the inner wall. The food holder further comprises an absorbent material positioned between said outer and said inner walls for absorbing liquids.

The absorbent material may further comprise a channel or a plurality of channels in the form of a labyrinth of channels. The labyrinth of channels may also include a plurality of openings at a top portion that allows liquid, such as melted ice cream to enter the labyrinth at a plurality of locations which helps to limit clogging effects of for instance, milk solids. This presents the advantage that drips are directed away from the food which may include an ice cream cone so that the cone does not become soggy. The labyrinth further has the advantage that it prevents liquid that drips down inside the labyrinth from spilling out if the holder is momentarily tilted.

It is still further contemplated that the inner wall and the outer wall may be provided with a laminate polyethylene film. Yet further, a lower edge of the inner wall and a lower edge of the outer wall may be provided having substantially the same diameter. In addition, a restriction may further be provided formed of an elastically deformable material such that when the food is inserted into the holder the restriction engages with a surface of the food and elastically expands around the surface as the food is advanced into the holder, the restriction forming a liquid tight seal around the food. The ease of installation and removal of the holder due to the restriction allows the individual to quickly and easily remove it if they desire to consume the food which may comprise for instance, an ice cream cone.

In another advantageous embodiment an ice cream cone and cone holder is provided comprising an inner wall following a contour of the ice cream cone, and an outer wall following a contour that is different than the contour of the inner wall. The cone holder further comprises an absorbent material positioned between the outer and the inner walls for absorbing melted ice cream.

In still another advantageous embodiment a food holder is provided comprising an inner wall substantially following a contour of the food inserted therein, and an outer wall following a contour that is different than the contour of the inner wall. The food holder further comprises at least one channel wall defining at least one channel positioned between the outer and the inner walls, the at least one channel provided for receiving and maintaining liquids therein.

While the invention has been described in particular with reference to ice cream cones, it is contemplated that the invention may equally be used with any type of food in which a liquid will run therefrom including for instance, condiments.

The invention and its particular features and advantages will become more apparent form the following detailed description considered with reference to the accompanying drawings.

DETAILED DESCRIPTION OF THE DRAWINGS

Figure 1:
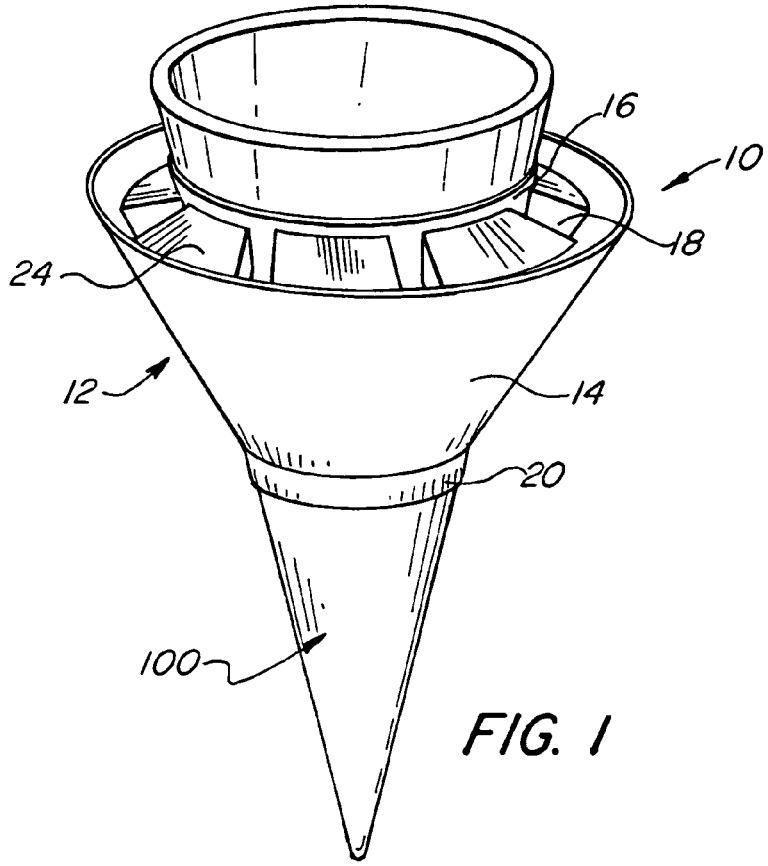
FIG. 1 is an illustration of one advantageous embodiment of the present invention showing a perspective view of the holder for use with a conical shaped cone.

Referring now to the drawings, wherein like reference numerals designate corresponding structure throughout the views.

FIG. 1 is an illustration of the holder 10 with an ice cream cone 100 inserted therein. As can be seen from the drawing, holder 10 essentially comprises a sleeve 12 that fits over cone 100. Holder 10 may comprise any suitable material and may be disposable or re-usable as desired. For instance, holder 10 may in one embodiment comprise a paper product having a sealing finish such as a polyethylene film. Alternatively, holder 10 may comprise a re-useable material such as a polymer.

Sleeve 12 comprises outer wall 14 and inner wall 16. As can be seen from FIG. 2, the angle of inner wall 16 generally follows the angle or a contour of the food, which in this example is cone 100 whereas the contour of outer wall 14 is different than the contour of cone 100 such that melting ice cream (not shown) may drip down into holder 10 between inner wall 16 and outer wall 14.

Also provided in sleeve 12 is a plurality of openings 18 located between channel walls 24 that allow melting ice cream to drip down into sleeve 12.

Still further provided is restriction 20 located at a lower end of sleeve 12. Restriction 20 is may be provided to engage with cone 100 as it is advanced into holder 10. Restriction may in one advantageous embodiment comprise an elastically deformable material that may expand as cone 100 is inserted thereby providing a seal so that if any melted ice cream were to get between inner wall 16 and cone 100, restriction 20 would not allow the melted ice cream to drain further downward. In addition, the interference connection provides a secure connection between cone 100 and cone holder 10.

Figure 2:
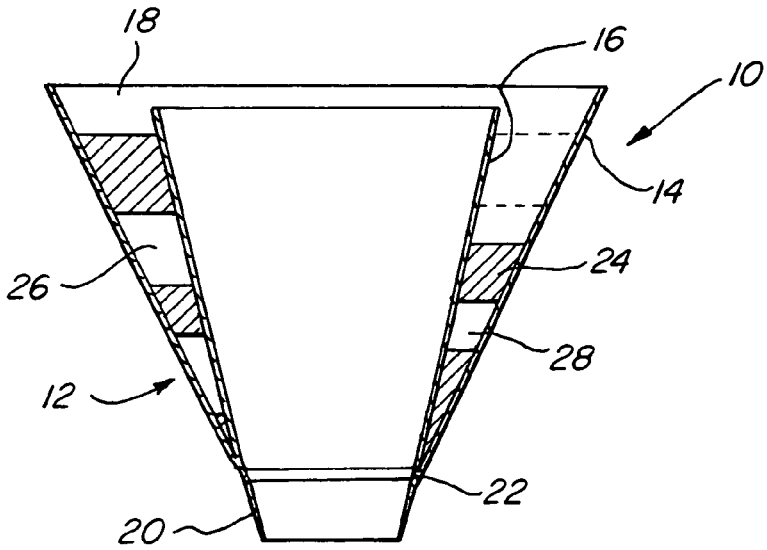
FIG. 2 is a sectional view of the holder according to FIG. 1.

Referring now to FIG. 2 a cross-section drawing is illustrated showing holder 10. As can be seen, inner wall 16 and outer wall 14 are bonded at their common smaller diameter 22 located at the bottom of sleeve 12.

Also illustrated in FIG. 2 is absorbent material in the form of channel walls 24 which are located in the space formed between inner wall 16 and outer wall 14 and forms channels 26. The function of channels 26 is to generate extended surface area of the absorbent material for efficient liquid absorption and limitation of the clogging effects of for instance, milk solids. It should also be noted that the channel walls 24 (FIGS. 1 & 2) provide support to the holder 10 and maintain inner wall 16 and outer wall 14 concentric.

Channels 26 further form interconnections 28 and are connected to openings 18 formed between inner wall 16 and outer wall 14. Openings 18 allow liquid, such as melted ice cream to flow to the internal areas of holder 10 such that it may be readily absorbed and contained within holder 10.

Figure 3:
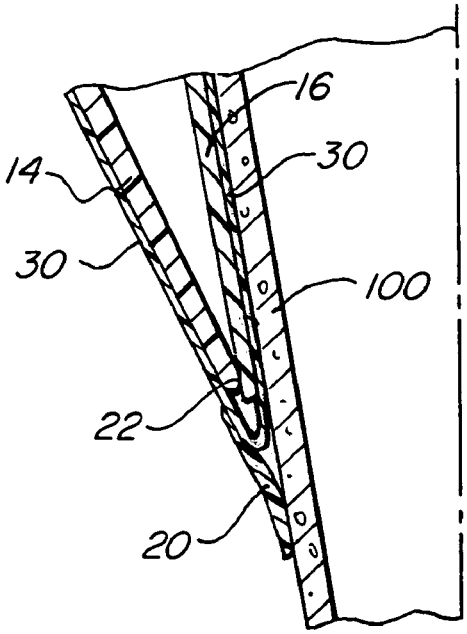
FIG. 3 is an enlarged view of a portion of FIG. 2 according to one advantageous embodiment.

FIG. 3 is an enlarged view of the lower portion of sleeve 12 illustrating the connection of inner wall 16 and outer wall 14 along with restriction 20. In one advantageous embodiment, inner wall 16 and outer wall 14 are provided with a polyethylene film 30 functioning as a moisture barrier. Here, restriction 20 may comprise a thin polyethylene film or other elastically expanding material that would expand and conform to the surface shape of the food, which in this instance comprises an inserted cone 100.

Figure 4:
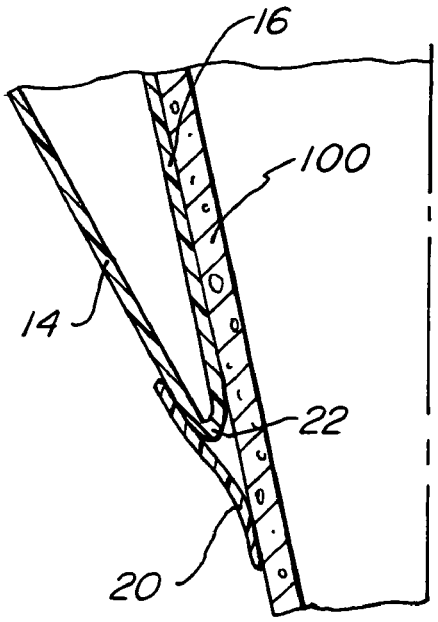
FIG. 4 is an enlarged view of a portion of FIG. 2 according to another advantageous embodiment.

FIG. 4 comprises still another alternate embodiment where inner wall 16 and outer wall 14 are formed by a one piece construction method utilizing for instance a polymer or plastic material. Again, in this embodiment, restriction 20 may be formed from a thin polyethylene film that can conform to the shape of cone 100.

Figure 5:
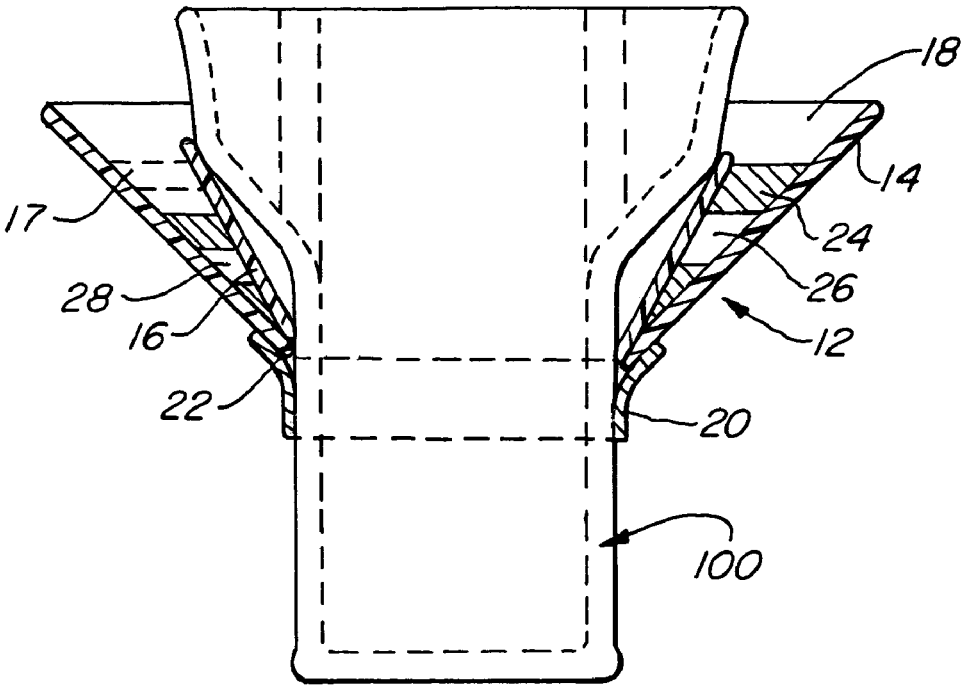
FIG. 5 is an illustration of another advantageous embodiment of the present invention showing a sectional view of the holder for use with an essentially cylindrically shaped cone.

A cross-sectional view of still another advantageous embodiment is illustrated in FIG. 5. Holder 10 as illustrated in FIG. 5 is similar to that described in connection with FIG. 1 except is formed to fit with a generally cylindrical shaped cone rather than a generally conical shaped cone.

Figure 6:
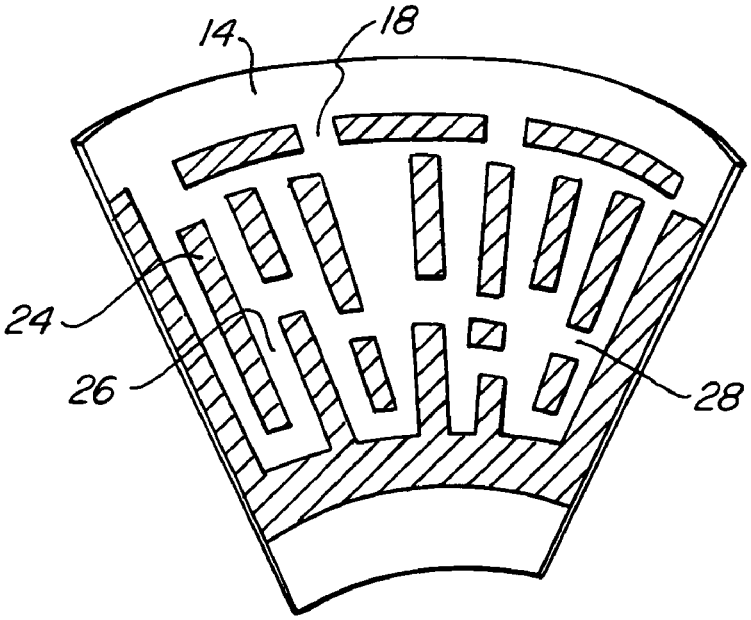
FIG. 6 is an unfolded flat pattern of channel forms according to FIGS. 1 and 5.

FIG. 6 is an unfolded flat pattern of holder 10 with for instance, inner wall 16 removed so as to further illustrate one advantageous embodiment with the absorbent material forming a labyrinth. In this embodiment, openings 18 are provided to allow melted ice cream to enter into the labyrinth.

The labyrinth is formed by the combination of channel walls 24, channels 26 and interconnections 28. In this manner a maximum surface area of the absorbent material may come into contact with the melted ice cream. Typically the channel width will be about ⅛ of an inch permitting gravity flow of the liquid such as for instance, melted ice cream throughout the labyrinth. A major benefit for the relatively small channel size is that in the event the food such as cone 100 is momentarily tilted or inverted, backflow of the liquid is minimized preventing spilling. Still further in another advantageous embodiment the absorbent material to channel ratio may be approximately 1 to 1 such that the absorbent material surface is optimized.

It is further contemplated that the labyrinth may not comprise an absorbent material but may simply comprise other materials inserted or integral to inner and/or outer walls 14, 16 and form a containment for the liquid such that when an individual tilts cone 100, the liquid contained in the containment (which comprises for instance at least one channel) will be maintained therein to prevent spilling.

As previously described, the holder 10 may be disposable or re-useable. It is further contemplated that advertisements and/or decorations may be located on an outer side of outer wall 14. Still further, while the holder 10 has primarily been described in connection with use with ice cream, it is contemplated and it may effectively be utilized with any food to capture liquid therefrom such as condiments, and especially any frozen confection such as for instance, frozen yogurt or any other confection that would melt and drip down on the individual.

Although the invention has been described with reference to particular ingredients and formulations and the like, these are not intended to exhaust all possible arrangements or features, and indeed many other modifications and variations will be ascertainable to those of skill in the art.

What is claimed is:

1. A food holder comprising:

an inner wall substantially following a contour of the food inserted therein;

an outer wall following a contour that is different than the contour of said inner wall;

an absorbent material positioned between said outer and said inner walls for absorbing liquids;

said absorbent material having a channel located therein and positioned between said inner and said outer walls.

2. The food holder according to claim 1 wherein said absorbent material comprises a plurality of channels.

3. The ice cream cone holder according to claim 2 wherein said plurality of channels comprises a series of interconnections for connecting said plurality of channels to each other.

4. The food holder according to claim 3 wherein said plurality of channels includes a plurality of openings at a top portion thereof to allow liquid to enter the plurality of channels at a plurality of locations.

5. The food holder according to claim 3 wherein an absorbent material to channel ratio of the plurality of channels is approximately 1 to 1.

6. The food holder according to claim 1 wherein the channel is up to approximately ⅛ inch in width.

7. The food holder according to claim 1 wherein a lower edge of said inner wall and a lower edge of said outer wall have substantially the same diameter.

8. The food holder according to claim 1 wherein said inner wall and said outer wall are formed as a single unit.

9. The food holder according to claim 1 wherein said inner and said outer walls comprise a disposable material.

10. The food holder according to claim 9 wherein at least one of said inner wall or said outer wall is laminated with a polyethylene film.

11. The food holder according to claim 1 further comprising a restriction located at a lower edge of said outer wall and formed of an elastically deformable material such that when food is inserted into the holder the restriction engages with a surface of the food and elastically expands around the surface of the food as the food is advanced into the holder, the restriction forming a liquid tight seal around the food.

12. The food holder according to claim 11 wherein said restriction comprises a polyethylene material.

13. The food holder according to claim 1 wherein the food comprises an ice cream cone.

14. An ice cream cone and cone holder comprising:

an inner wall following a contour of the ice cream cone;

an outer wall following a contour that is different than the contour of said inner wall;

an absorbent material positioned between said outer and said inner walls for absorbing melted ice cream;

said absorbent material having a channel located therein and positioned between said inner and said outer walls.

15. The ice cream cone and cone holder according to claim 14 further comprising a channel located in said absorbent material to allow non-absorbent liquids and solids to pass therethrough.

16. A food holder comprising:

an inner wall substantially following a contour of the food inserted therein;

an outer wall following a contour that is different than the contour of said inner wall;

at least one cavity wall defining at least an upper portion of a cavity positioned between said outer and said inner walls, the cavity provided for receiving and maintaining liquids therein such that when the food holder is tilted off axis the liquid is substantially maintained within the cavity.

17. The food holder according to claim 16 wherein said at least one channel wall comprises an absorbent material.

18. The food holder according to claim 16 wherein said cavity comprises a labyrinth of cavities positioned between said outer and said inner walls.

* * * * *